US008632068B2

(12) United States Patent
Takimoto

(10) Patent No.: US 8,632,068 B2
(45) Date of Patent: Jan. 21, 2014

(54) IMAGE FORMING APPARATUS WITH SHEET PUSH MEMBER PUSHING IN HORIZONTAL DIRECTION

(75) Inventor: Yuichiro Takimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/541,013

(22) Filed: Jul. 3, 2012

(65) Prior Publication Data

US 2013/0009357 A1 Jan. 10, 2013

(30) Foreign Application Priority Data

Jul. 5, 2011 (JP) ..... 2011-149281

(51) Int. Cl.
*B65H 31/26* (2006.01)

(52) U.S. Cl.
CPC ..... *B65H 31/26* (2013.01)
USPC ..... 271/220

(58) Field of Classification Search
USPC ..... 271/220, 221, 222
See application file for complete search history.

(56) References Cited

U.S. PATENT DOCUMENTS 5,228,679 A * 7/1993 Borostyan ..... 271/220
6,722,651 B2 * 4/2004 Fujisawa et al. ..... 271/220

FOREIGN PATENT DOCUMENTS

JP H02-204270 A 8/1990
JP 2003-081515 A 3/2003
JP 2008-143616 A 6/2008

OTHER PUBLICATIONS

English Abstract and Machine Translation for JP 2008-143616 A, published Jun. 26, 2008.
English Abstract and Machine Translation for JP 2003-081515 A, published Mar. 19, 2003.
English Abstract for JP H02-204270 A, published Aug. 14, 1990.

* cited by examiner

*Primary Examiner* — Gerald McClain
(74) *Attorney, Agent, or Firm* — NDQ&M Watchstone LLP

(57) ABSTRACT

An image forming apparatus including a sheet ejection portion, an in-housing ejection space, and a sheet push mechanism. The sheet push mechanism composed of a sheet push member whose lower end portion touches a sheet ejection surface of the in-housing ejection space and which is movable to a downstream side in the sheet ejection direction, and a holder portion which supports movably an upper end portion of the sheet push member with the holder portion positioned on the lower surface and movable between a reference position where the sheet push member pushes the sheet ejected on the sheet ejection surface and an evacuation position away from the reference position in a horizontal direction.

10 Claims, 6 Drawing Sheets

IMAGE FORMING APPARATUS WITH SHEET PUSH MEMBER PUSHING IN HORIZONTAL DIRECTION

INCORPORATION BY REFERENCE

This application is based on and claims the benefit of priority from Japanese Patent Application No. 2011-149281 filed on Jul. 5, 2011, the contents of which are hereby incorporated by reference.

BACKGROUND

The present disclosure relates to an image forming apparatus such as a copy machine, a facsimile, a printer and the like, more particularly, to an image forming apparatus that is provided with an in-housing ejection space between an image forming portion and an image read portion.

Conventionally, a paper-sheet post-process device (paper sheet post-process portion) is known, which stacks a plurality of paper sheets on each of which an image is formed by an image forming apparatus such as a copy machine, a facsimile and the like; and is able to execute a process such as a bind process of collecting the stacked paper sheets and binding them by means of a stapler. When applying post-processes such as the bind process and the like to a relatively large quantity of paper sheets, the above paper-sheet post-process device is used.

Besides, as an image forming apparatus, there is an image forming apparatus of in-housing ejection space type, which includes an image read portion above an image forming portion; and is provided with an in-housing ejection space between the image read portion and the image forming portion. A paper sheet ejection tray is disposed on a bottom surface portion of the in-housing ejection space; a paper sheet ejected into the paper sheet ejection tray after image forming is taken out from a front side of an apparatus main body.

To process the paper sheet, on which an image is formed by such an image forming apparatus of the in-housing ejection space type, by means of the paper sheet post-process device, it is necessary to carry the paper sheet passing through the image forming portion to the paper sheet pot-process device via the in-housing ejection space. Because of this, conventionally, the in-housing ejection space is provided therein with a relay unit (relay carry portion) for carrying the paper sheet after the image forming to the paper sheet post-process device. In the image forming apparatus of the in-housing ejection type that is provided with the relay unit, the paper sheet ejected from a paper sheet ejection opening is stocked onto an upper surface of the relay unit.

Here, in a structure of the relay unit, the unit upper surface has a flat shape. Because of this, an upper surface of the already stocked paper sheet is rubbed by a tip end of a paper sheet ejected from the paper sheet ejection opening, or a tip end of a paper sheet that is switched back from the paper sheet ejection opening during a double-side print time, whereby the stocked paper sheet is likely to be moved in an ejection direction. And, there is a problem that the next ejected paper sheet pushes a rear end of the paper sheet moved in the switch back time to disturb the paper sheet stock state; or the next paper sheet slips under the paper sheet to disrupt the stock order.

To avoid this, a measure is known, in which a movable paper sheet push member is disposed to hang down from a ceiling surface of the in-housing ejection space to the upper surface of the relay unit that is an paper sheet ejection surface. By pushing the upper surface of the already stocked paper sheet by means of the paper sheet push member, it is possible to alleviate the movement of the stocked paper sheet and prevent the disturbance of the stock state and the disruption of the stock order.

However, in the case where the paper sheet push member is disposed from the ceiling surface of the in-housing ejection space so as to touch the paper sheet ejection surface, the paper sheet push member is invisible to a standing user. Because of this, when the user inserts a hand into an inner portion of the in-housing ejection space to take out a stocked small-sized paper sheet such as a postcard and the like, there is a risk that the hand hits the paper sheet push member to be injured or damages the paper sheet push member. Here, even in a case where the relay unit is not used, if the paper sheet push member, which hangs down from the ceiling surface of the in-housing ejection space to the paper sheet ejection tray, is used, the same problem arises.

SUMMARY

In light of the above problems, it is an object of the present disclosure to provide an image forming apparatus that is able to: raise the ability to stock a paper sheet by means of a paper sheet push member that is ejected into an in-housing ejection space; and avoid injury and damage to the paper sheet push member during a time of taking out a stocked paper sheet.

To achieve the above object, an image forming apparatus according to one aspect of the present disclosure includes: a sheet ejection portion that is disposed between an image forming portion and an image read portion disposed above the image forming portion and ejects a sheet on which an image is formed at the image forming portion; an in-housing ejection space that is formed in a downstream side in a sheet ejection direction with respect to the sheet ejection portion and is opened at least to a front side of the image forming apparatus; a sheet push mechanism that is disposed on a lower surface of the image read portion and pushes an upper surface of a sheet which is ejected from the sheet ejection portion to the in-housing ejection space; wherein the sheet push mechanism is composed of: a sheet push member whose lower end portion touches a sheet ejection surface of the in-housing ejection space and which is movable to a downstream side in the sheet ejection direction; and a holder portion which supports movably an upper end portion of the sheet push member; and the holder portion is disposed on the lower surface to be movable between a reference position where the sheet push member pushes the sheet ejected on the sheet ejection surface and an evacuation position away from the reference position in a horizontal direction.

Still other objects of the present disclosure and specific advantages obtained by the present disclosure will become more apparent from the following description of preferred embodiments.

DETAILED DESCRIPTION

Figure 1:
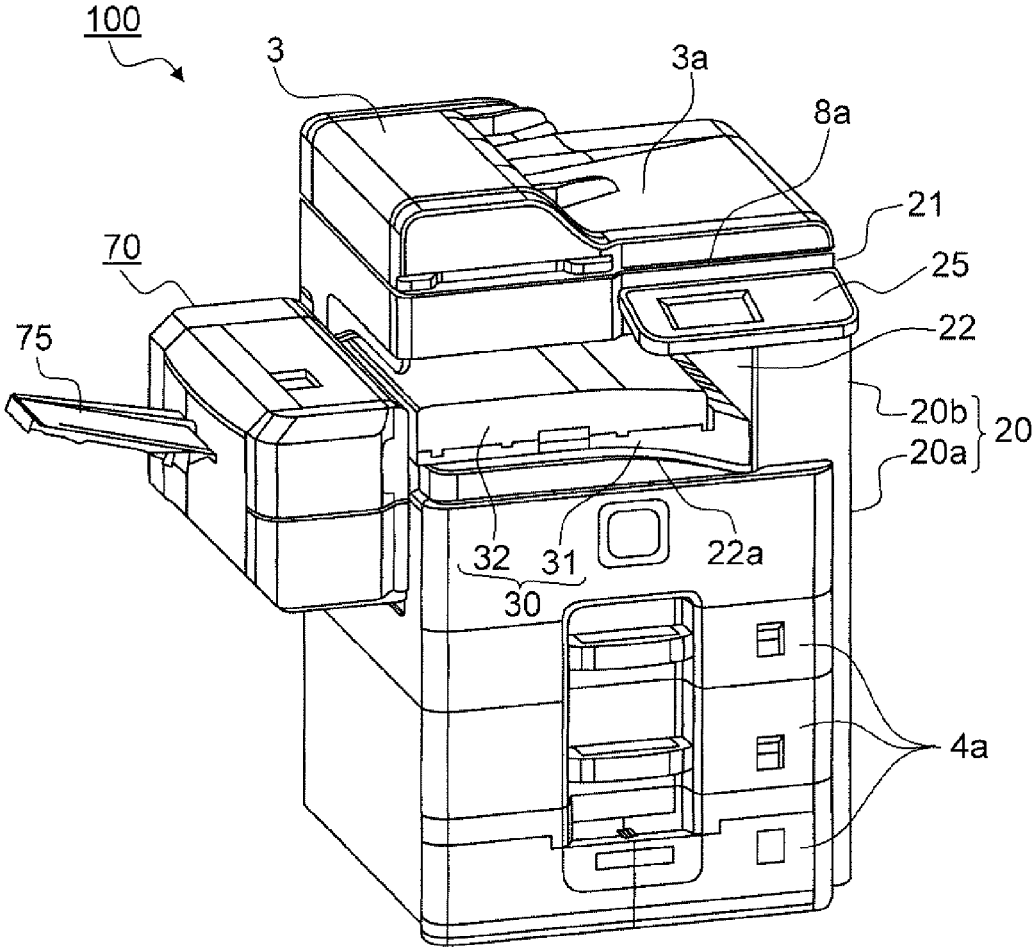
FIG. 1 is an appearance perspective view of an image forming apparatus 100 according to an embodiment of the present disclosure.
Figure 2:
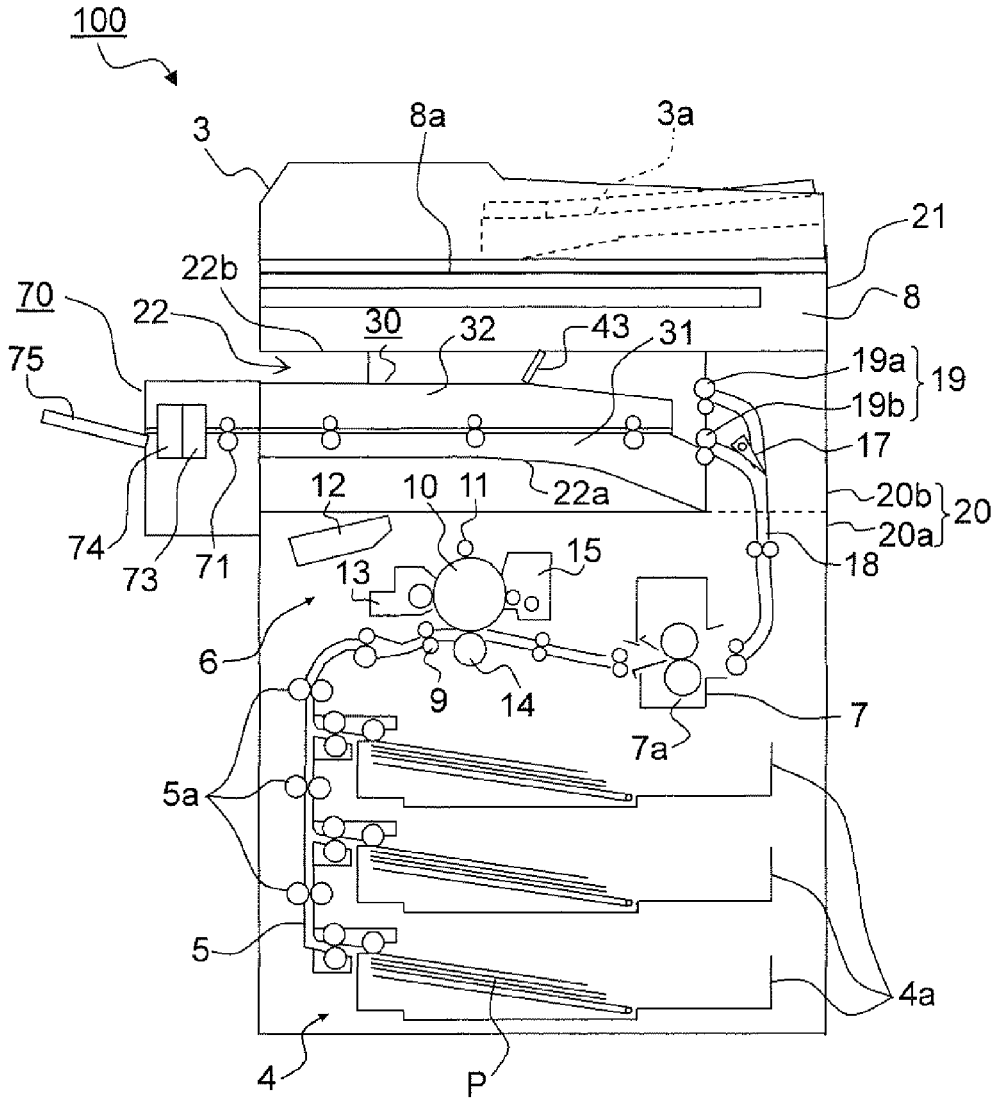
FIG. 2 is a schematic view showing an internal structure of an image forming apparatus 100 according to an embodiment of the present disclosure.

Hereinafter, embodiments of the present disclosure are described with reference to the drawings. FIG. 1 is an appearance perspective view of the image forming apparatus 100 according to an embodiment of the present disclosure, and FIG. 2 is a schematic view showing an internal structure of the image forming apparatus 100. Here, in the present embodiment, as an example of the image forming apparatus, a multifunction machine is described; however, an image forming apparatus of the in-housing ejection type is also applicable, for example, to a laser printer, an ink jet printer, a facsimile and the like other than the multi-function machine.

As shown in FIG. 1 and FIG. 2, the image forming apparatus 100 is a digital multi-function machine of the so-called in-housing ejection type, and roughly composed of a main body housing 20 and an upper housing 21 that is disposed on the main body housing. The upper housing 21 is provided with described-later various mechanisms that read an image of a document as an electric signal, and an upper portion of the upper housing 21 is provided with a document carry device 3. On the other hand, the main body housing 20 is provided with later-described various mechanisms that transfer the image onto a paper sheet based on the electric signal of the read document image, and a left side portion of the main body housing 20 is provided with a paper sheet post-process device (paper sheet post-process means) 70.

In the present embodiment, the main body housing 20 is composed of a lower housing 20*a*, and a connection housing 20*b* that is on the lower housing, situated along a right side portion and connected to the upper housing 21. The lower housing 20*a* is provided with a paper sheet supply portion 4 for a paper sheet P, an image forming portion 6 for forming a toner image on the paper sheet P, a fix device (fix portion) 7 for fixing the toner image of the paper sheet P and the like. On the other hand, the connection housing 20*b* is provided with a paper sheet ejection portion (sheet ejection portion) 19 that carries the paper sheet P after the fixing and ejects the paper sheet from the main body housing 20.

Besides, a left side of the connection housing 20*b* right under the upper housing 21 is provided with an in-housing ejection space 22 that is widely opened from a left surface toward a front surface. This in-housing ejection space 22 is provided with a relay unit 30 that receives and stacks the paper sheet P that is ejected from a left surface of the connection housing 20*b*, while allowing the paper sheet P to be carried to the paper sheet post-process device 70 when applying a post-process to the paper sheet P. Details of the relay unit 30 are described later.

The main body housing 20 is provided therein with the paper sheet supply portion 4 disposed in a lower portion, a paper sheet carry portion 5 disposed to side of and above the paper sheet supply portion 4, the image forming portion 6 disposed above the paper sheet supply portion 4, and the fix portion 7 disposed in a downstream side (right side of FIG. 2) in a paper sheet carry direction with respect to the image forming portion 6.

The paper sheet supply portion 4 is provided with a plurality of paper sheet supply cassettes 4*a* each of which is equipped with a separation supply means such as a paper sheet supply roller and the like in the downstream side in the paper sheet carry direction, and supplies one paper sheet P after another to the paper sheet carry portion 5 beginning with the uppermost paper sheet P of a bundle of the paper sheets P by means of rotation operation of the paper sheet supply roller. The paper sheet carry portion 5 carries the paper sheet P, which is carried from the paper sheet supply portion 4, to the image forming portion 6 by means of each pair of carry rollers 5*a*.

The image forming portion 6 and the fix portion 7 are disposed elongatively in the main body housing 20 in a width direction (a back-forth direction of the image forming apparatus 100, that is, a direction that meets the paper surface of FIG. 2 at right angles) that meets the paper sheet carry direction, and in an upper portion in the lower housing 20*a*, in the order from the left side of FIG. 2, the image forming portion 6 and the fix portion 7 are successively disposed in the carry direction (from left to right direction) of the paper sheet P.

The image forming portion 6 forms a predetermined toner image onto the paper sheet P by means of an electro-photographic process, includes a photosensitive drum 10 that is an image carrier rotatably supported on a shaft, and an electrification device 11, a light exposure device 12, a development device 13, a transfer device 14, a cleaning device 15 and a not-shown electricity removal device that are disposed around the photosensitive drum 10 in the rotation direction. The fix portion 7 makes a pair of fix rollers 7*a*, which includes a heat roller and a pressure roller, sandwich the paper sheet P on which a toner image is transferred at the image forming portion 6 to heat and pressurize the paper sheet, thereby fixing the non-fixed toner image onto the paper sheet P.

The upper housing 21 is provided therein with an image read portion 8. The image read portion 8 reads image information of a document, in a case of manually placing one document after another and reading them, the document carry device 3 is opened and the documents are placed on a contact glass 8*a* that is disposed on an upper surface of the upper housing 21. And, in a case of automatically reading one document after another from a bundle of documents, the bundle of documents is placed on a paper sheet supply tray 3*a* of the document carry device 3 that is in a closed state. In the case where the bundle of documents is placed on the paper sheet supply tray 3*a*, the documents are successively automatically fed onto the contact glass 8*a* one after another from the bundle of documents. In any case, light is shined onto the paper sheet placed on the contact glass 8*a* from a not-shown exposure lamp, and the reflected light is guided as image light to a photoelectric transducing portion (CCD) via an optical system that includes a not-shown reflection mirror, an image forming lens and the like.

Hereinafter, basic operation of the image forming apparatus 100 having the above structure is described. First, a surface of the photosensitive drum 10, which rotates in a counterclockwise direction in FIG. 2, is evenly electrified by the electrification device 11. And, then, a laser beam from the light exposure device 12 (laser device and the like) is directed onto a circumferential surface of the photosensitive drum 10 based on the image information that is read by the image read portion 8, whereby an electrostatic latent image is formed on the surface of the photosensitive drum 10. Toner as a developer is supplied from the development device 13 to this electrostatic latent image, whereby a toner image is formed.

Next, the paper sheets P placed on the paper sheet supply cassette 4 of the paper sheet supply portion 4 pass through the paper sheet carry path 5 one after another, and are carried, by a pair of registration rollers 9 at predetermined timing, to the photosensitive drum 10 on which the toner image is formed. The toner image on the surface of the photosensitive drum 10 is transferred onto the paper sheet P by the transfer device 14 that includes a transfer roller and the like. And, the paper sheet P, to which the toner image is transferred, is separated from the photosensitive drum 10, carried to the fix portion 7, and passes through the pair of fix rollers 7*a* to be heated and pressurized, whereby the toner image fixed.

As for the photosensitive drum 10 which completes the transfer process for transferring the toner image onto the paper sheet P, toner remaining on the circumferential surface is removed by the cleaning device 15, thereafter, an electricity removal process is performed to remove remaining charges by means of the electricity removal device (not shown). Thereafter, the electrification process is again applied to the circumferential surface by the electrification device 11, whereby the image forming is performed hereinafter in the same way.

And, the paper sheet P passing through the fix portion 7 turns its way in a vertical direction, and is carried as it is into the connection housing 20*b* along a vertical carry path 18. An upper portion of the vertical carry path 18 is branched in two upper and lower carry paths toward the left in the connection housing 20*b*, and the carry direction of the paper sheet P is switched by a switch claw 17 that is disposed at the branch portion.

This connection housing 20*b* is provided therein with the paper sheet ejection portion 19. The paper sheet ejection portion 19 has a pair of first ejection rollers 19*a* and a pair of second ejection rollers 19*b* that are disposed right under the pair of first ejection rollers 19*a*, and the paper sheet P carried through the vertical carry path 18 is guided to the upper carry path or the lower carry path by the switch claw 17.

The paper sheet P, which is guided to the upper carry path by the switch claw 17, is ejected from the pair of first ejection rollers 19*a* to the left, while the paper sheet P, which is guided to the lower carry path by the switch claw 17, is ejected to the left by the pair of second ejection rollers 19*b*. The switch claw 17 switches the guide direction by means of a not-shown control portion.

Here, the relay unit 30 is disposed attachably and detachably on a bottom surface 22*a* of the in-housing ejection space 22, and the in-housing ejection space 22 is provided with a detection sensor (not shown) that detects disposition of the relay unit 30. The detection sensor is composed of a PI sensor (photo-interrupter sensor) and the like, and transmits a detection result to the control portion.

Besides, the bottom surface 22*a* is provided with an inclination surface that is inclined upward toward the downstream side (the left side of FIG. 2) in the paper sheet ejection direction, and when the relay unit 30 is removed from the in-housing ejection space 22, the bottom surface 22*a* is used as a paper sheet ejection tray. In this case, the detection sensor detects that the relay unit 30 is not disposed, and when the detection result is transmitted to the control portion, the switch claw 17 guides the paper sheet P to the pair of first ejection rollers 19*a*. And, the paper sheet P, which is ejected by the pair of first ejection rollers 19*a*, is ejected onto the bottom surface 22*a*.

On the other hand, when the relay unit 30 is disposed in the in-housing ejection space 22, the detection sensor detects that the relay unit 30 is disposed, and when the detection result is transmitted to the control portion, the switch claw 17 guides the paper sheet P to the pair of second ejection rollers 19*b*. And, the paper sheet P, which is ejected by the pair of second ejection rollers 19*b*, is carried into the relay unit 30. The paper sheet P carried into the relay unit 30 passes in the relay unit 30 to be carried to the paper sheet post-process device 70.

Here, the detection result is displayed on an operation panel 25 (see FIG. 1), whereby a user is able to switch the guide direction of the paper sheet P on the operation panel 25. Besides, an upper surface portion 30*a* (see FIG. 3) of the relay unit 30, which is composed of an upper guide portion 32, composes a paper sheet ejection tray on which the paper sheet P ejected from the pair of first ejection rollers 19*a* is placed.

Besides, even in the case where the relay unit 30 is disposed, in a case where a thin paper sheet P is used or in a case where received data of a facsimile are printed, it is possible to eject the paper sheet P from the pair of first ejection rollers 19*a* to the upper surface portion (sheet ejection surface) 30*a* of the relay unit 30. A ceiling surface 22*b* of the in-housing ejection space 22 supports a paper sheet push member (sheet push member) 43 that hangs down to push the upper surface of the paper sheet P ejected on the upper surface 30*a*. A structure of a paper sheet push mechanism (sheet push mechanism) 40 (see FIG. 4), which includes the paper sheet push member 43, is described later.

The paper sheet post-process device 70 is disposed in the downstream side (the left side of FIG. 1 and FIG. 2) in the paper sheet carry direction with respect to the main body housing 20. The paper sheet post-process device 70 applies post-processes, such as a bind process, a shift ejection process of deviating and ejecting the paper sheets P and the like, to the paper sheets P that undergo the image forming process in the main body housing 20.

As shown in FIG. 2, the paper sheet post-process device 70 is provided therein with a pair of post-process carry rollers 71 for carrying the paper sheet P, which is carried from the relay unit 30, to the downstream side, a bind process device 73 for stacking a plurality of the carried paper sheets P and binding a bundle of the stacked paper sheets P by means of a stapler, and a shift ejection device 74 for deviating the paper sheets P or a bundle of paper sheets and ejecting them.

When the paper sheet P, which undergoes the image forming process, is carried into the paper sheet post-process device 70 via the relay unit 30, in a case where the bind process is instructed by the not-shown control portion, a bundle of a predetermined number of paper sheets are aligned by the bind process device 73, thereafter, the bind process is applied at a predetermined position of the bundle of paper sheets. On the other hand, in a case where the bind process is not instructed, the paper sheets P pass through the bind process device 73 as they are and are ejected to an ejection tray 75.

Besides, in a case where the shift ejection process is instructed, the paper sheets P or a bundle of the paper sheets P are deviated, and the shift ejection process is applied at a predetermined position of the ejection tray 75, while in a case where the shift ejection process is not instructed, the paper sheets P pass through the shift ejection device 74 as they are and ejected to the ejection tray 75.

Figure 3:
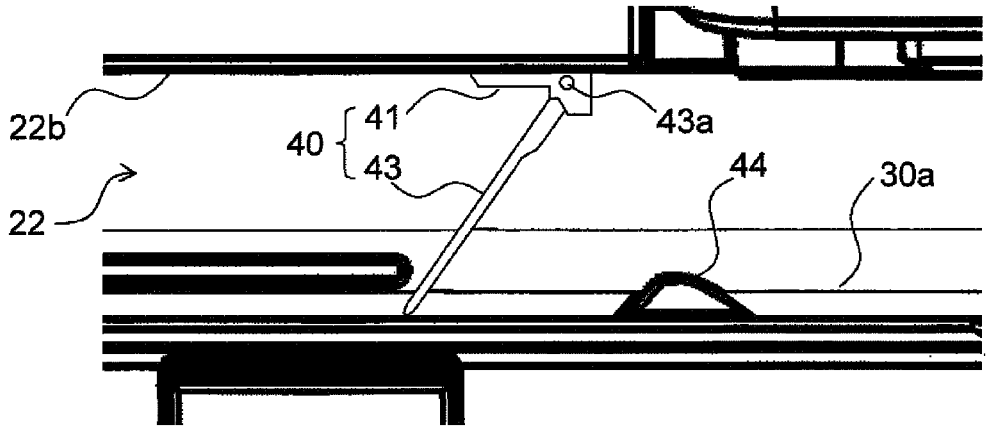
FIG. 3 is a side view of peripherals around a paper sheet push mechanism 40 that is disposed in an in-housing ejection space 22 of an image forming apparatus 100 according to a first embodiment of the present disclosure.
Figure 4:
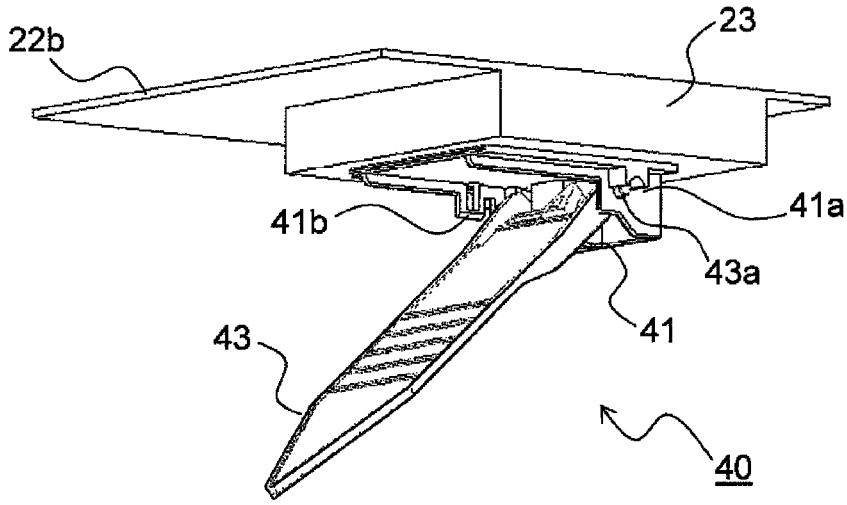
FIG. 4 is a perspective view of the paper sheet push mechanism 40 disposed in the image forming apparatus 100 according to the first embodiment.
Figure 5:
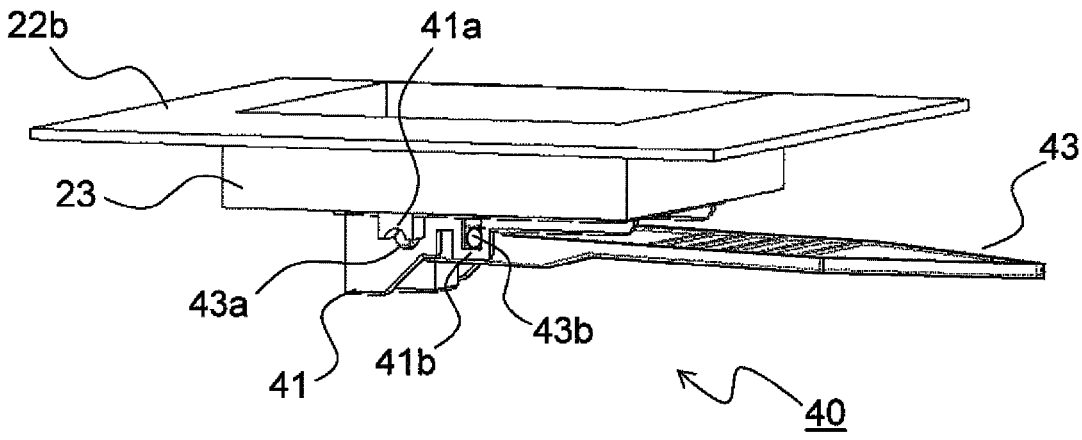
FIG. 5 is a perspective view showing a state in which a paper sheet push member 43 for the paper sheet push mechanism 40, which is disposed in the image forming apparatus 100 according to the first embodiment, is housed along a ceiling surface 22*b* of the in-housing ejection space 22.
Figure 6:
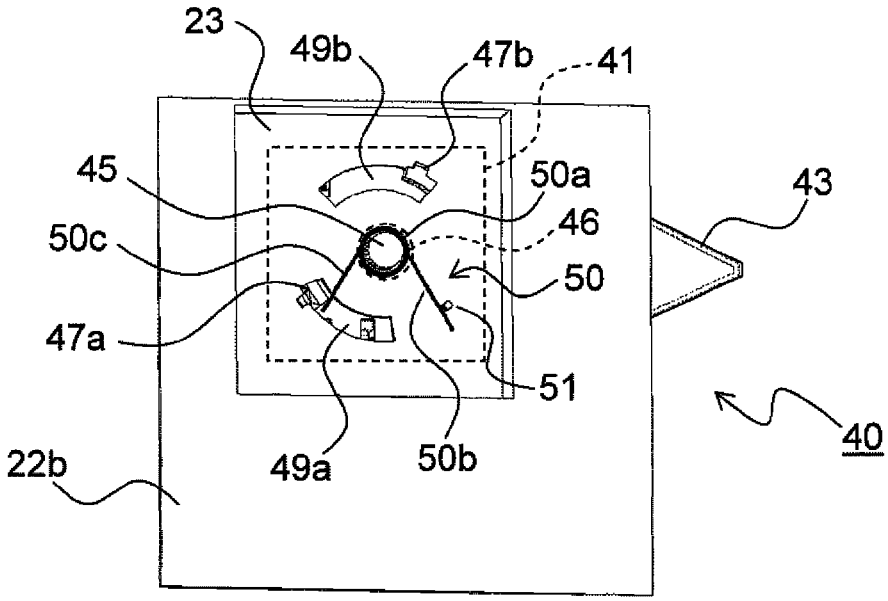
FIG. 6 is a plan view of the paper sheet push mechanism 40 disposed in the image forming apparatus 100 according to the first embodiment when viewing from top of FIG. 5.

FIG. 3 is a side view of peripherals around the paper sheet push mechanism 40 that is disposed in then in-housing ejection space 22 of the image forming apparatus 100 according to a first embodiment of the present disclosure, FIG. 4 is a perspective view of the paper sheet push mechanism 40 used in the image forming apparatus 100 according to the first embodiment, FIG. 5 is a perspective view of the paper sheet push mechanism 40 showing a state in which the paper sheet push member 43 is housed along the ceiling surface 22*b* of the in-housing ejection space 22, FIG. 6 is a plan view when viewing the paper sheet push mechanism 40 from top of FIG. 5. Here, FIG. 5 shows a state when viewing the paper sheet push mechanism 40 from an inner portion of the in-housing ejection space 22, and the paper sheet carry direction is a direction opposite (from left to right direction of FIG. 5) to the direction in FIG. 4.

The paper sheet push mechanism 40 is composed of a holder portion 41 that is disposed on a mount portion 23 (not shown in FIG. 3) which is integrally formed with the ceiling surface 22*b* (a lower surface of the image read portion 8) of the in-housing ejection space 22, and the flat plate-shaped paper sheet push member 43 that hangs down from the holder portion 41. A lower end portion of the paper sheet push member 43 butts the upper surface portion 30*a* of the relay unit 30. Besides, the upper surface portion 30*a* is provided with a projection 44 in an upstream side in the paper sheet ejection direction (from right to left direction of FIG. 3) with respect to the paper sheet push member 43.

As shown in FIG. 4, an upper end of the paper sheet push member 43 is provided with a support shaft 43*a* that protrudes left and right, and the support shaft 43*a* rotatably engages with a bearing portion 41*a* of the holder portion 41. According to this, the paper sheet push member 43 is movably supported by the holder portion 41. Besides, the holder portion 41 is provided with an engagement portion 41*b* that engages with a projection 43*b* of the paper sheet push member 43, and in a case where the relay unit 30 and the paper sheet post-process device 70 are not used, as shown in FIG. 5, by engaging the projection 43*b* with the engagement portion 41*b*, it is possible to house the paper sheet push member 43 along the ceiling surface 22*b* (the lower surface of the image read portion 8) of the in-housing ejection space 22.

Besides, as shown in FIG. 6, an upper surface of the holder portion 41 is provided with an rotation shaft 45 and two first engagement claws 47*a* and 47*b*, and the rotation shaft 45 is rotatably inserted in a bearing hole 46 that is formed in the mount portion 23. Besides, the first engagement claws 47*a* and 47*b* engage with first guide holes 49*a* and 49*b* that are formed to have an arc shape with respect to a bearing hole 47 of the mount portion 23. The first guide holes 49*a* and 49*b* guide the holder portion 41 to a position (hereinafter, called a reference position) where the paper sheet push member 43 moves in the paper sheet ejection direction to push the paper sheet that is ejected to the upper surface portion 30*a* and to a position (hereinafter, called a first evacuation position) which is away from the reference position by a predetermined rotation amount in a horizontal direction.

Here, in FIG. 6, an upper side shows a front side of the in-housing ejection space 22, and the holder portion 41 is disposed on the mount portion 23 such that a side end portion of the paper sheet push member 43 situated in the front side (the paper surface front side in FIG. 3) of the in-housing ejection space 22 rotates from the downstream side to the upstream side (from left to right of FIG. 3) in the paper sheet ejection direction.

A rear side of the mount portion 23 is provided with a torsional spring 50. The torsional spring 50 is composed of a helical spring 50*a* that is disposed on the rotation shaft 45 of the holder portion 41, a first arm portion 50*b* and a second arm portion 50*c* that extend from the helical spring 50*a* in different directions. The first arm portion 50*b* is fixed to an engagement piece 51 that is formed on the rear surface of the mount portion 23, while the second arm portion 50*c* engages with the first engagement claw 47*a* of the holder portion 41.

According to the above structure, the holder portion 41 is rotatably supported in the horizontal direction by the ceiling surface 22*b* of the in-housing ejection space 22 via the mount portion 23, and is biased in a predetermined direction (clockwise direction of FIG. 6) with respect to the rotation shaft 45 by a bias force of the torsional spring 50. And, in a free state, the holder portion 41 is disposed at the reference position, and as shown in FIG. 3, the paper sheet push member 43 is movable in the paper sheet ejection direction, and the lower end portion of the paper sheet push member 43 is able to push the paper sheet ejected to the upper surface portion 30*a*.

Next, operation of the paper sheet push mechanism 40 is described. As for the paper sheet that is ejected from the pair of first ejection rollers 19*a* to the upper surface portion 30*a* of the relay unit 30, a tip end portion is bent obliquely upward and butts a substantially central portion of the paper sheet push member 43. The paper sheet pushes up the paper sheet push member 43 toward the downstream side in the paper sheet ejection direction, is ejected along the upper surface portion 30*a*, and stocked at a predetermined position of the upper surface portion 30*a* with pushed by the lower end of the paper sheet push member 43.

According to this, even if the upper surface of the already stocked paper sheet is rubbed by the tip ends of paper sheets that are successively ejected from the pair of first ejection rollers 19*a* or by the tip ends of paper sheets switched back from the pair of first ejection rollers 19*a* during a double-side print time, the already stocked paper sheet becomes unlikely to move in the paper sheet carry direction. Accordingly, because of the structure, it is possible to prevent the paper sheet stock state on the flat-shape upper surface portion 30*a* of the relay unit 30 from being disturbed or to prevent the subsequent paper sheets from slipping under the already stocked paper sheet to disrupt the stock order.

On the other hand, in a case where the paper sheet stocked on the upper surface portion 30*a* is taken out, the user tries to insert a hand into the in-housing ejection space 22 from the front side of the image forming apparatus 100, however, the connection housing 20*b* is present in the upstream side (the right side of FIG. 1) in the paper sheet ejection direction, accordingly, the user often inserts the hand from the downstream side (the left side of FIG. 1) in the paper sheet ejection direction instead of inserting from the front side of the image forming apparatus 100. In this case, if the user inserts the hand into an inner portion of the in-housing ejection space 22, the hand is likely to hit the paper sheet push member 43.

Figure 7:
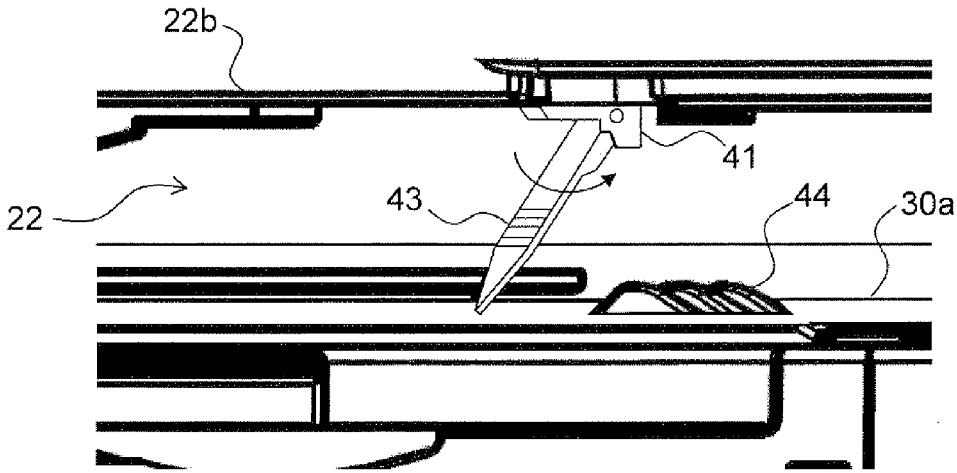
FIG. 7 is a side view of peripherals around the paper sheet push mechanism 40 that shows a state in which a holder portion 41 of the paper sheet push mechanism 40 disposed in the image forming apparatus 100 according to the first embodiment rotates in a horizontal direction from the state of FIG. 3.

However, as described above, in the present embodiment, the holder portion 41 supporting the paper sheet push member 43 is rotatable in the horizontal direction with respect to the ceiling surface 22*b* (the mount portion 23) of the in-housing ejection space 22, accordingly, as shown in FIG. 7, the holder portion 41 counters the bias force of the torsional spring 50 thanks to the impact and rotates in the horizontal direction (toward the first evacuation position, a counterclockwise direction of FIG. 6), whereby also the side end portion of the paper sheet push member 43 situated in the front side of the image forming apparatus 100 rotates from the downstream side in the paper sheet ejection direction to the upstream side, accordingly, the impact when the hand hits the paper sheet push member 43 is eased. Accordingly, it is possible to avoid injury of the user and damage to the paper sheet push mechanism 40. Besides, the lower end portion of the paper sheet push member 43 has a sharp shape and is in point contact with the upper surface portion 30*a* of the relay unit 30, accordingly, the holder portion 14 supporting the paper sheet push member 43 is unlikely to rotate in the horizontal direction.

Besides, the holder portion 41 rotating toward the first evacuation position rotates in an opposite direction (clockwise direction of FIG. 6) thanks to the bias force of the torsional spring 50 and is automatically disposed at the reference position. According to this, there is also no risk of forgetting to return the holder portion 41 to the reference position.

In the meantime, here, the rotation shaft 45 is disposed at the substantially central portion of the holder portion 41, however, the rotation shaft 45 of the holder portion 41 may be disposed at an inner portion of the in-housing ejection space 22. In this case, the side end portion of the paper sheet push member 43 situated in the front side of the in-housing ejection space 22 becomes largely rotatable, accordingly, it is possible to more effectively ease the impact when the hand hits the paper sheet push member 43.

Figure 8:
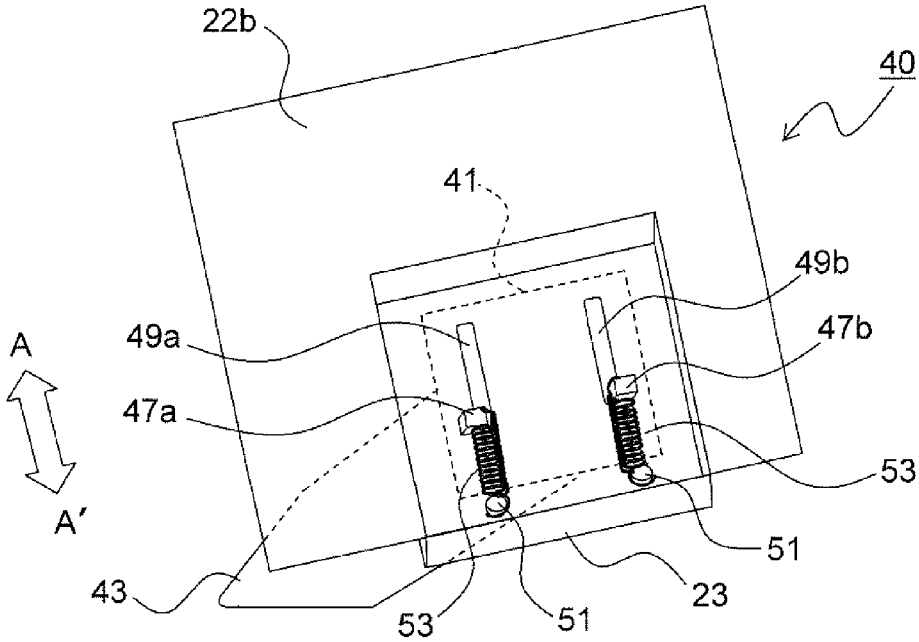
FIG. 8 is a plan view when viewing from top the paper sheet push mechanism 40 disposed in the image forming apparatus 100 according to a second embodiment of the present disclosure.

FIG. 8 is a plan view when viewing from top the paper sheet push mechanism 40 used in the image forming apparatus 100 according to a second embodiment of the present disclosure. As shown in FIG. 8, the upper surface of the holder portion 41 is provided with the two first engagement claws 47*a* and 47*b*, and the first engagement claws 47*a* and 47*b* engage with the pair of first guide holes 49*a* and 49*b* formed linearly in the mount portion 23, respectively. The first guide holes 49*a* and 49*b* guide the holder portion 41 to a reference position where the paper sheet push member 43 pushes the paper sheet ejected to the upper surface portion 30*a* and to a position (hereinafter, called a second evacuation position) which is moved from the reference position by a predetermined amount in an inward direction (arrow A direction) of the in-housing ejection space 22.

The rear side of the mount portion 23 is provided with two tension springs 53. One end of each tension spring 53 is fixed to the engagement piece 51 that is formed on the rear surface of the mount portion 23, while the other ends of the tension springs 53 engage with the first engagement claws 47*a* and 47*b* of the holder portion 41, respectively.

Figure 9:
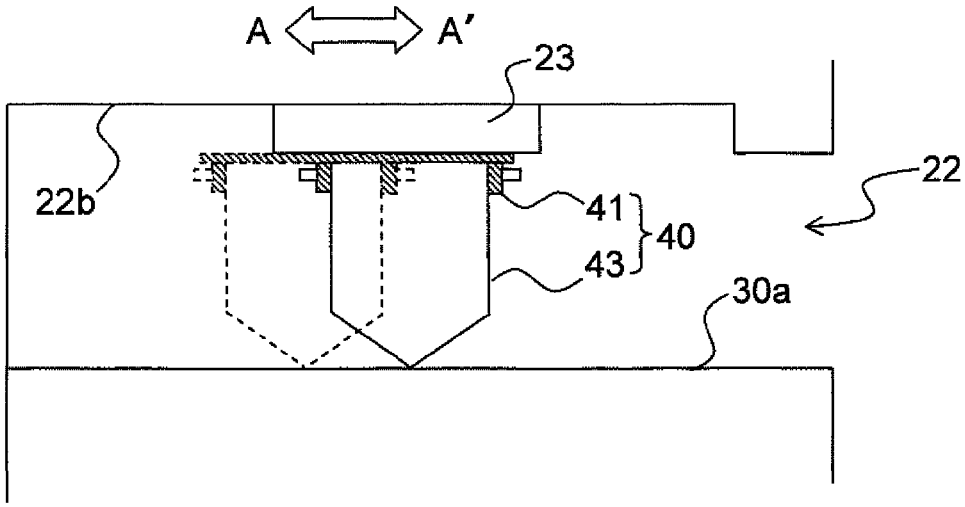
FIG. 9 is a front view showing a state in which the holder portion 41 of the paper sheet push mechanism 40 disposed in the image forming apparatus 100 according to the second embodiment moves in a horizontal direction.

According to the structure in the present embodiment, as shown in FIG. 9, the holder portion 41 supporting the paper sheet push member 43 is slidable, with respect to the ceiling surface 22*b* (the mount portion 23) of the in-housing ejection space 22, in a direction (arrow AA' direction) that meets the paper sheet ejection direction at right angles. According to this, in a case where the user inserts the hand into the in-housing ejection space 22 from the front side (the right side of FIG. 9) of the image forming apparatus 100 main body and hits the paper sheet push member 43, the holder portion 41 counters the bias force of the tension spring 53 thanks to the impact and moves in the inward direction (toward the second evacuation position, the arrow A direction) of the in-housing ejection space 22, whereby the impact is eased. Accordingly, it is possible to avoid injury of the user and damage to the paper sheet push mechanism 40 in the case where the user inserts the hand into the in-housing ejection space 22 from the front surface of the image forming apparatus 100.

Besides, the holder portion 41 moving toward the second evacuation position is pulled back toward the front side (the A' direction) of the in-housing ejection space 22 by the bias force of the tension spring 53 and is automatically disposed at the reference position. According to this, there is also no risk of forgetting to return the holder portion 41 to the reference position.

Figure 10:
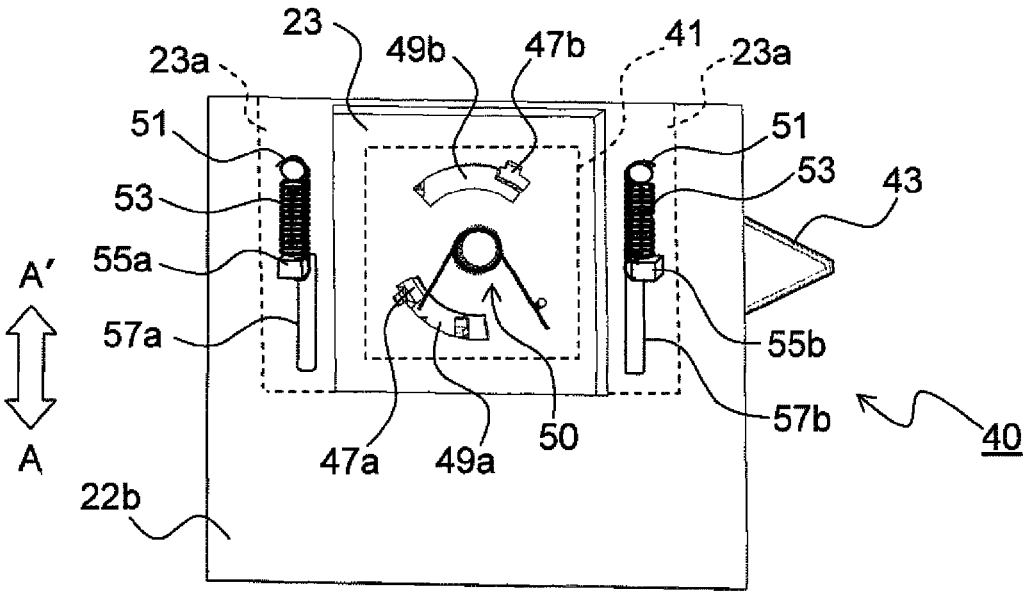
FIG. 10 is a plan view when viewing from top the paper sheet push mechanism 40 disposed in the image forming apparatus 100 according to a third embodiment of the present disclosure.

FIG. 10 is a plan view when viewing from top the paper sheet push mechanism 40 used in the image forming apparatus 100 according to a third embodiment of the present disclosure. As shown in FIG. 10, the mount portion 23 is formed of a material different from the ceiling surface 22*b* of the in-housing ejection space 22, and flange portions 23*a* are formed at end edges that oppose each other in the paper sheet ejection direction (left-right direction of FIG. 10). As for the mount portion 23, the second engagement claws 55*a* and 55*b* formed on the flange portion 23*a* engage with a pair of second guide holes 57*a* and 57*b* that are linearly formed in the ceiling surface 22*b*. The second guide holes 57*a* and 57*b* guide the mount portion 23 to a reference position where the paper sheet push member 43 pushes the paper sheet ejected to the upper surface portion 30*a* and to a second evacuation position which is moved from the reference position by a predetermined amount in an inward direction (arrow A direction) of the in-housing ejection space 22.

The rear side of the ceiling surface 22*b* is provided with the two tension springs 53. One end of each tension spring 53 is fixed to the engagement piece 51 that is formed on the rear surface of the ceiling surface 22*b*, while the other ends of the tension springs 53 engage with the second engagement claws 55*a* and 55*b* of the flange portion 23, respectively. The structure of the holder portion 41 and the rotation structure of the holder portion 41 with respect to the mount portion 23 are the same as in the first embodiment, accordingly, description is skipped.

According to the structure in the present embodiment, the holder portion 41 supporting the paper sheet push member 43 is disposed on the mount portion 23 to be rotatable between the reference position and the first evacuation position. Besides, the mount portion 23 is disposed on the ceiling surface 22*b* of the in-housing ejection space 22 to be slidable between the reference position and the second evacuation position, while the holder portion 41 is slidable together with the mount portion 23 between the reference position and the second evacuation position.

Accordingly, it is possible to ease both impacts in the case where the user inserts the hand from the downstream side (the left side of FIG. 1) in the paper sheet ejection direction instead of inserting from the front surface of the image forming apparatus 100 to hit the paper sheet push member 43 and in the case where the user inserts the hand into the in-housing ejection space 22 from the front surface of the image forming apparatus 100 to hit the paper sheet push member 43, and it is possible to more effectively avoid injury of the user and damage to the paper sheet push mechanism 40. Besides, the holder portion 41 is disposed on the mount portion 23, which composes a portion of the lower surface of the image read portion 8, to be rotatable between the reference position and the first evacuation position and is movable together with the mount portion 23 between the reference position and the second evacuation position, accordingly, it is possible to allow the holder portion 41 to rotate and move with respect to the lower surface of the image forming portion 8 by means of a simple structure.

Besides the present disclosure is not limited to each of the above embodiments, and various modifications are possible without departing the spirit of the present disclosure. For example, in each of the above embodiments, the structure is employed, in which the holder portion 41 is biased toward the reference position by using the torsional spring 50 or the tension spring 53, however, also other springs such as a compression spring and the like are usable. Besides, the engagement portion 41*b* and the projection 43*b* shown in each of the above embodiments are not essential constituent elements in the present disclosure, and a structure also is employable, in which these elements are not disposed.

Besides, in each of the above embodiments, the paper sheet post-process device 70 is disposed on the left surface of the main body housing 20, however, in addition, it is also possible to use a large paper sheet post-process device which is disposed on a floor independent of the main body housing 20. Besides, in a case where the connection housing 20*b* is present on the left side of the image forming apparatus 100 and the paper sheet is ejected from left to right of the in-housing ejection space 22, the use inserts the hand from the right side instead of inserting from the front side of the image forming apparatus 100, accordingly, the rotation direction of the holder portion 41 in the first and third embodiments may be a reverse direction.

Further, even in a structure in which the relay unit 30 and the paper sheet post-process device 70 are not disposed, the present disclosure is applicable to a structure in which the bottom surface 22*a* of the in-housing ejection space 22 is used as a paper sheet ejection surface and the lower end portion of the paper sheet push member 43 touches the bottom surface 22*a* of the in-housing ejection space 22. Besides, here, as an example of the sheet that is ejected to the in-housing ejection space 22, the paper sheet P is described, however, for example, other sheet-shaped recording medium such as an OHP sheet and the like may be used.

The present disclosure is applicable to an image forming apparatus that is provided with an in-housing ejection space for ejecting a paper sheet, on which an image is formed by an image forming portion, between the image forming portion and an image read portion. By using the present disclosure, it is possible to provide an image forming apparatus which is able to raise the ability to stock the paper sheet ejected into the in-housing ejection space and to avoid injury of a user and damage to a paper sheet push mechanism during a time of taking out a stocked paper sheet.

What is claimed is:

1. An image forming apparatus with sheet pushing in a horizontal directs comprising:

a sheet ejection portion that is disposed between an image forming portion and an image read portion disposed above the image forming portion and ejects a sheet on which an image is formed at the image forming portion;

an in-housing ejection space that is formed in a downstream side in a sheet ejection direction with respect to the sheet ejection portion and is opened at least to a front side of the image forming apparatus;

a sheet push mechanism that is disposed on a lower surface of the image read portion and pushes an upper surface of a sheet which is ejected from the sheet ejection portion to the in-housing ejection space; wherein the sheet push mechanism is composed of: a sheet push member whose lower end portion touches a sheet ejection surface of the in-housing ejection space and which is movable to a downstream side in the sheet ejection direction; and a holder portion which supports movably a support shaft formed at an upper end portion of the sheet push member; and the holder portion is disposed on the lower surface to be movable between a reference position where the sheet push member pushes the sheet ejected on the sheet ejection surface and a first evacuation position where the support shaft of the paper sheet push member, which extends from the front side to a rear side of the image forming apparatus, is rotated around a fixed vertical shaft disposed on the holder portion by a predetermined amount in a horizontal direction from the reference position, and movable between the reference position and a second evacuation position situated at an inner portion of the in-housing ejection space in a direction that meets the paper sheet ejection direction at right angles.

2. The image forming apparatus according to claim 1, wherein the holder portion is movable between the reference position and a first evacuation position to which a side end portion of the sheet push member situated at the front side of the image forming apparatus rotates from the reference position by a predetermined amount from the downstream side to an upstream side in the sheet ejection direction.

3. The image forming apparatus according to claim 2, wherein an upper surface of the holder portion is provided with a rotation shaft and two engagement claws; the rotation shaft is rotatably inserted in a bearing hole which is formed in the lower surface of the image read portion; the first engagement claws engage slidably with two first guide holes respectively which are formed to have an arch shape with respect to the bearing hole in the lower surface of the image read portion.

4. The image forming apparatus according to claim 2, wherein a lower end portion of the sheet push member is in point contact with the sheet ejection surface of the in-housing ejection space.

5. The image forming apparatus according to claim 1, wherein the holder portion is provided with an engagement portion that engages with the sheet push member along the lower surface of the image read portion.

6. The image forming apparatus according to claim 1, wherein an upper surface of the holder portion is provided with two first engagement claws which slidably engage respectively with a pair of first guide holes formed linearly in the lower surface of the image read portion.

7. The image forming apparatus according to claim 1, wherein a bias member is disposed to bias the holder portion toward the reference position.

8. The image forming apparatus according to claim 1, further comprising a sheet post-process portion which is disposed on a side opposite to the sheet ejection portion with respect to the in-housing ejection space interposed therebetween; and a relay carry portion that is disposed on a bottom surface portion of the in-housing ejection space and carries the sheet, which is ejected from the sheet ejection portion, to the sheet post-process portion; wherein a lower end portion of the sheet push mechanism touches an upper surface of the relay carry portion that defines the sheet ejection surface.

9. The image forming apparatus according to claim 1, wherein the holder portion is supported by a mount portion, which composes a portion of the lower surface of the image read portion, rotatably between the reference position and the first evacuation position; and is movable together with the mount portion between the reference position and the second evacuation position.

10. The image forming apparatus according to claim 9, wherein a bias member is disposed to bias the holder portion and the mount portion toward the reference position.

* * * * *